US006496057B2

(12) United States Patent
Wada et al.

(10) Patent No.: US 6,496,057 B2
(45) Date of Patent: Dec. 17, 2002

(54) CONSTANT CURRENT GENERATION CIRCUIT, CONSTANT VOLTAGE GENERATION CIRCUIT, CONSTANT VOLTAGE/CONSTANT CURRENT GENERATION CIRCUIT, AND AMPLIFICATION CIRCUIT

(75) Inventors: Atsushi Wada, Ogaki (JP); Kuniyuki Tani, Ogaki (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 0 days.

(21) Appl. No.: 09/921,787

(22) Filed: Aug. 6, 2001

(65) Prior Publication Data

US 2002/0036536 A1 Mar. 28, 2002

(30) Foreign Application Priority Data

Aug. 10, 2000 (JP) ..... 2000-243473

(51) Int. Cl.[7] ..... G05F 1/10
(52) U.S. Cl. ..... 327/543

(58) Field of Search ..... 327/530, 534, 327/535, 537, 538, 541, 543, 545, 546

(56) References Cited

U.S. PATENT DOCUMENTS 5,744,999 A * 4/1998 Kim et al. ..... 323/312
5,831,473 A * 11/1998 Ishii ..... 323/313
6,346,848 B1 * 2/2002 Shkap ..... 323/312

* cited by examiner

*Primary Examiner*—Jeffrey Zweizig
(74) *Attorney, Agent, or Firm*—Armstrong, Westerman & Hattori, LLP

(57) ABSTRACT

A current flows through an n-channel MOS field effect transistor in a constant current generation circuit, and a current which is equal to or a constant multiple of the current flows through a resistor. A bias is set such that the transistor operates in a saturation region. A voltage applied across both ends of a resistor is uniquely determined by a gate-source voltage of the transistor. The difference between a threshold voltage of the transistor and a voltage applied across both ends of the resistor is set within a range of 0.1 volts to 0.4 volts, so that the current flowing through the resistor is made constant without depending on the temperature change.

22 Claims, 7 Drawing Sheets

CONSTANT CURRENT GENERATION CIRCUIT, CONSTANT VOLTAGE GENERATION CIRCUIT, CONSTANT VOLTAGE/CONSTANT CURRENT GENERATION CIRCUIT, AND AMPLIFICATION CIRCUIT

BACKGROUND OF THE INVENTION

1. Field of the Invention

The present invention relates to a constant current generation circuit for generating a constant current, a constant voltage generation circuit for generating a constant voltage, a constant voltage/constant current generation circuit for generating a constant voltage and a constant current, and an amplification circuit using the same.

2. Description of the Background Art

Reference current generation circuits for generating constant reference currents and reference voltage generation circuits for generating constant reference voltages are used for various analog circuits. In ALPC (Auto Laser Power Control) circuits and A/D (Analog-to-Digital) converters for CD (Compact Disk) drives, for example, constant voltage generation circuits for generating constant reference voltages which do not depend on the variation in power supply voltage, the temperature change, and the variation in processes are required.

On the other hand, frequency characteristics of operational amplifiers greatly depend on bias currents. If the bias currents are constant, the dependency on the variation in power supply voltage, the temperature change, and the variation in processes can be reduced, thereby making it possible to realize high-performance analog circuits. From such a point of view, constant current generation circuits are important in order to supply constant bias currents.

In recent years, the above-mentioned analog circuits such as the ALPC circuits, the A/D converters, and the operational amplifiers have been made one chip using the CMOS (Complementary Metal-Oxide Semiconductor) process. In this case, the constant voltage generation circuits and the constant current generation circuits must be designed by CMOS circuits.

Currents generated by the constant current generation circuits using the CMOS circuits vary by the variation in power supply voltage, the temperature change, and the variation in processes. The amount of the variation in this case is significantly large.

FIG. 8 is a circuit diagram showing an example of a conventional constant current generation circuit.

The constant current generation circuit shown in FIG. 8 is constituted by p-channel MOS field effect transistors 81, 82, and 87, n-channel MOS field effect transistors 83, 84, 85, and 86, and a resistor 88.

The transistor 81 has its source connected to a power supply terminal receiving a power supply voltage, has its drain connected to a node N81, and has its gate connected to a node N82. The transistor 82 has its source connected to the power supply terminal, and has its drain and its gate connected to the node N82. The transistor 83 has its drain connected to the node N81, has its source connected to a node N83, and has its gate connected to a node N84. The transistor 84 has its drain connected to the node N82, has its source connected to the node N84, and has its gate connected to the node N81.

The transistor 85 has its drain connected to the node N83, has its source connected to a ground terminal, and has its gate fed with an inverted stand-by signal STB. The transistor 86 has its drain connected to the node N84 through the resistor 88, has its source connected to the ground terminal, and has its gate fed with the inverted stand-by signal STB. The transistor 87 has its source connected to the power supply terminal, has its gate connected to the node N82, and has its drain supplied with a current IC.

The transistors 81 and 82 constitute a current mirror circuit, and a current which is equal or proportional to a current flowing through the transistor 81 flows through the transistor 82.

In the constant current generation circuit shown in FIG. 8, when the inverted stand-by signal STB enters a high level, the transistors 85 and 86 are turned on. Consequently, a current Ir flows from the power supply terminal to the ground terminal through the transistors 82 and 84, the resistor 88, and the transistor 86.

A current It which is equal or proportional to the current Ir flows from the power supply terminal to the ground terminal through the transistors 81, 83, and 85. In this case, a voltage applied across both ends of the resistor 88 is uniquely determined by a gate-source voltage of the transistor 83. Consequently, a constant voltage is applied across both ends of the resistor 88 irrespective of the power supply voltage. Therefore, the current Ir flowing through the resistor 88 does not depend on the variation in the power supply voltage.

In this case, the current Ir flowing through the resistor 88 is determined by the following equation:

$$Ir=Va/R=\beta\cdot(Va-Vt)^2 \quad \text{(A1)}$$

Here, Va denotes a voltage applied across both ends of the resistor 88, that is, the gate-source voltage of the transistor 83, Vt denotes a threshold voltage of the transistor 83, and R denotes the resistance value of the resistor 88. Further, β is expressed by the following equation:

$$\beta=(1/2)\cdot(W/L)\cdot Cox\cdot\mu \quad \text{(A2)}$$

In the foregoing equation (A2), W denotes the gate width of the transistor 83, L denotes the gate length of the transistor 83, Cox denotes the capacitance of a unit oxide film of the transistor 83, and $\mu$ denotes the mobility of electrons or holes.

Conventionally, a bias voltage has been set such that the gate-source voltage of the transistor 83 is approximately equal to the threshold voltage Vt.

As described in the foregoing, in the constant current generation circuit shown in FIG. 8, the current IC is constant without depending on the variation in the power supply voltage. However, β, Vt, and R in the foregoing equation (A2) vary depending on the variation in processes, and the current Ir and the voltage Va also vary depending on the temperature change. Consequently, it is impossible to obtain a constant current which does not depend on the temperature change and the variation in processes.

When a constant voltage generation circuit for generating a constant voltage is constructed using a CMOS circuit, a constant current generated by the constant current generation circuit is generally converted into a constant voltage using a resistance load. When the constant voltage generation circuit is constructed using the constant current generation circuit shown in FIG. 8, the current IC is converted into a voltage using the resistor. Also in this case, the current IC varies by the temperature change and the variation in processes. Accordingly, it is impossible to obtain a constant voltage which does not depend on the temperature change and the variation in processes.

SUMMARY OF THE INVENTION

An object of the present invention is to provide a constant current generation circuit composed of a field effect transistor and capable of generating a constant current without depending on the variation in power supply voltage and the temperature change.

Another object of the present invention is to provide a constant current generation circuit composed of a field effect transistor and capable of generating a constant current without depending on the variation in power supply voltage, the temperature change, and the variation in processes.

Still another object of the present invention is to provide a constant voltage generation circuit composed of a field effect transistor and capable of generating a constant voltage without depending on the variation in power supply voltage, the temperature change, and the variation in processes.

A further object of the present invention is to provide a constant voltage/constant current generation circuit composed of a field effect transistor and capable of generating a constant current and a constant voltage without depending on the variation in power supply voltage, the temperature change, and the variation in processes and an amplification circuit using the same.

A constant current generation circuit according to an aspect of the present invention comprises a first field effect transistor having a threshold voltage Vt; and a first resistor, the first field effect transistor and the first resistor being connected to each other such that the first field effect transistor operates in a saturation region, a voltage applied across both ends of the first resistor is uniquely determined by a gate-source voltage of the first field effect transistor, and a current flowing through the first field effect transistor and a current flowing through the first resistor are equal or proportional to each other, and the gate-source voltage of the first field effect transistor being set within a range of not less than (Vt+0.1) volts nor more than (Vt+0.4) volts.

In the constant current generation circuit, the first field effect transistor operates in the saturation region, and the voltage applied across both ends of the first resistor is uniquely determined by the gate-source voltage of the first field effect transistor. Accordingly, the voltage applied across both ends of the first resistor does not depend on the variation in power supply voltage. Further, the gate-source voltage of the first field effect transistor is set within a range of not less than (Vt+0.1) volts nor more than (V+0.4) volts, so that the voltage applied across both ends of the first resistor does not depend on the temperature change. Consequently, a constant current can be generated without depending on the variation in power supply voltage and the temperature change.

The constant current generation circuit may further comprise a first current mirror circuit for respectively causing currents which are equal or proportional to each other to flow through the first field effect transistor and the first resistor.

In this case, the currents which are equal or proportional to each other are respectively caused to flow through the first field effect transistor and the first resistor by the first current mirror circuit.

The constant current generation circuit may further comprise a second field effect transistor. The first current mirror circuit may comprise third and fourth field effect transistors. The first field effect transistor may have its gate electrically connected to one end of the resistor, have its source electrically connected to the other end of the resistor, and have its drain electrically connected to the drain of the third field effect transistor, the second field effect transistor may have its gate electrically connected to the drain of the first field effect transistor, have its source electrically connected to the one end of the resistor, and have its drain electrically connected to the drain of the fourth field effect transistor, the third field effect transistor may have its source electrically connected to a predetermined potential, and have its gate electrically connected to the gate and the drain of the fourth field effect transistor, and the fourth field effect transistor may have its source electrically connected to the predetermined potential.

In this case, when a current follows through the third field effect transistor and the first field effect transistor, a current which is equal or proportional to the current flowing through the first field effect transistor flows through the fourth field effect transistor, the second field effect transistor, and the first resistor. Particularly, the first field effect transistor operates in the saturation region, and the first resistor is electrically connected between the gate and the source of the first field effect transistor. Accordingly, a voltage applied across both ends of the first resistor is uniquely determined by the gate-source voltage of the first field effect transistor.

The first, second, third and fourth field effect transistors may be metal oxide semiconductor field effect transistors (MOSFETs).

The constant current generation circuit may further comprise potential holding means for holding the drain of the first field effect transistor at a predetermined potential. In this case, the drain of the first field effect transistor is prevented from being stabilized at an undesired potential.

The resistance value of the first resistor may be adjustable at the time of at least the fabrication. Even when the characteristics of the first field effect transistor vary, therefore, the resistance value of the first resistor is adjusted, thereby making it possible to set the gate-source voltage of the first field effect transistor within a range of not less than (Vt+0.1) volts nor more than (Vt+0.4) volts.

In this case, a maker can adjust the resistance value, and a user who has purchased a product having the constant current generation circuit can also adjust the resistance value.

The first resistor may be composed of polycrystalline silicon. Consequently, the temperature coefficient of the first resistor can be reduced, thereby making it possible to obtain a constant current which does not depend on the temperature change. Further, the first resistor may be composed of two-layer polycrystalline silicon. Consequently, the temperature coefficient can be further reduced.

The gate length and the gate width of the first field effect transistor may be set such that the voltage applied across both ends of the first resistor at a first temperature and a voltage applied across both ends of the first resistor at a second temperature different from the first temperature are equal to each other.

Consequently, the voltage applied across the first resistor is made constant without depending on the temperature change between the first temperature and the second temperature. As a result, a constant current which does not depend on the power supply voltage can be obtained.

The first resistor may be constructed using a plurality of resistors and a switch, and may have a programmable function by switching the plurality of resistors using the switch.

A constant voltage generation circuit according to another aspect of the present invention comprises a constant current generation circuit; and a current/voltage conversion circuit for converting a current generated by the constant current generation circuit into a voltage, the constant current generation circuit comprising a first field effect transistor having a threshold voltage Vt, and a first resistor, the first field effect transistor and the first resistor being connected to each other such that the first field effect transistor operates in a saturation region, a voltage applied across both ends of the first resistor is uniquely determined by a gate-source voltage of the first field effect transistor, and a current flowing through the first field effect transistor and a current flowing through the first resistor are equal or proportional to each other, the gate-source voltage of the first field effect transistor being set within a range of not less than (Vt+0.1) volts nor more than (Vt+0.4) volts, and the current/voltage conversion circuit comprising a second resistor composed of the same material as that for the first resistor in the constant current generation circuit, and a second current mirror circuit for causing a current which is equal or proportional to a current flowing through the first resistor in the constant current generation circuit.

In the constant voltage generation circuit, the current which is equal or proportional to the current flowing through the first resistor in the constant current generation circuit flows through the second resistor by the second current mirror circuit. Consequently, the current is converted into the voltage. In this case, the current flowing through the first resistor in the constant current generation circuit is made constant without depending on the variation in power supply voltage and the temperature change. Accordingly, a constant voltage is generated at both ends of the second resistor without depending on the variation in power supply voltage and the temperature change.

The second resistor is composed of the same material as that for the first resistor. When the resistance value of the first resistor varies on processes, therefore, the resistance value of the second resistor similarly varies. When the current flowing through the first resistor in the constant current generation circuit varies by the variation in the resistance value of the first resistor, therefore, the variation in the voltage generated at both ends of the second resistor in the current/voltage conversion circuit can be offset by the variation in the resistance value of the second resistor. Consequently, a constant voltage can be generated without depending on the variation in processes.

The resistance value of the second resistor may be adjustable at the time of at least the fabrication. When the output voltage varies, therefore, the voltage generated at both ends of the second resistor can be set to a desired voltage by adjusting the resistance value of the second resistor.

In this case, a maker can adjust the resistance value, and a user who has purchased a product having the constant current generation circuit can also adjust the resistance value.

The constant current generation circuit may further comprise a first current mirror circuit for respectively causing currents which are equal or proportional to each other to flow through the first field effect transistor and the first resistor.

In this case, the currents which are equal or proportional to each other are respectively caused to flow through the first field effect transistor and the first resistor by the first current mirror circuit.

The constant current generation circuit may further comprise a second field effect transistor. The first current mirror circuit may comprise third and fourth field effect transistors. The first field effect transistor may have its gate electrically connected to one end of the resistor, have its source electrically connected to the other end of the resistor, and have its drain electrically connected to the third field effect transistor, the second field effect transistor may have its gate electrically connected to the drain of the first field effect transistor, have its source electrically connected to the one end of the resistor, and have its drain electrically connected to the drain of the fourth field effect transistor, the third field effect transistor may have its source electrically connected to a predetermined potential, and have its gate electrically connected to the gate and the drain of the fourth field effect transistor, and the fourth field effect transistor may have its source electrically connected to the predetermined potential.

In this case, when a current flows through the third field effect transistor and the first field effect transistor, a current which is equal or proportional to the current flowing through the first field effect transistor flows through the fourth field effect transistor, the second field effect transistor, and the first resistor. Particularly, the first field effect transistor operates in a saturation region, and the first resistor is electrically connected between the gate and the source of the first field effect transistor. Accordingly, the voltage applied across both ends of the first resistor is uniquely determined by the gate-source voltage of the first field effect transistor.

The first, second, third and fourth field effect transistors may be metal oxide semiconductor field effect transistors.

The constant current generation circuit may further comprise potential holding means for holding the drain of the first field effect transistor at a predetermined potential. In this case, the drain of the first field effect transistor is prevented from being stabilized at an undesired potential.

The resistance value of the first resistor may be adjustable at the time of at least the fabrication. When the characteristics of the first field effect transistor vary, therefore, the gate-source voltage of the first field effect transistor can be set within a range of not less than (Vt+0.1) volts nor more than (Vt+0.4) volts by adjusting the resistance value of the first resistor.

In this case, a maker can adjust the resistance value, and a user who has purchased a product having the constant current generation circuit can also adjust the resistance value.

The first resistor may be composed of polycrystalline silicon. Consequently, the temperature coefficient of the first resistor can be reduced, thereby making it possible to obtain a constant current which does not depend on the temperature change. Further, the first resistor may be composed of two-layer polycrystalline silicon. Consequently, the temperature coefficient can be further reduced.

The gate length and the gate width of the first field effect transistor may be set such that a voltage applied across both ends of the first resistor at a first temperature and a voltage applied across both ends of the first resistor at a second temperature different from the first temperature are equal to each other.

Consequently, the voltage applied across the first resistor is made constant without depending on the temperature change between the first temperature and the second temperature. As a result, a constant current which does not depend on the power supply voltage can be obtained.

The second resistor may be constructed using a plurality of resistors and a switch, and may have a programmable function by switching the plurality of resistors using the switch.

The first resistor may be constructed using a plurality of resistors and a switch, and may have a programmable function by switching the plurality of resistors using the switch.

A constant voltage/constant constant current generation circuit according to still another aspect of the present invention comprises a constant voltage generation circuit, the constant voltage generation circuit comprising a constant current generation circuit, and a current/voltage conversion circuit for converting a current generated by the constant current generation circuit into a voltage, the constant current generation circuit comprising a first field effect transistor having a threshold voltage Vt, and a first resistor, the first field effect transistor and the first resistor being connected to each other such that the first field effect transistor operates in a saturation region, a voltage applied across both ends of the first resistor is uniquely determined by a gate-source voltage of the first field effect transistor, and a current flowing through the first field effect transistor and a current flowing through the first resistor are equal or proportional to each other, the gate-source voltage of the first field effect transistor being set within a range of not less than (Vt+0.1) volts nor more than (Vt+0.4) volts, the current/voltage conversion circuit comprising a second resistor composed of the same material as that for the first resistor in the constant current generation circuit, and a second current mirror circuit for causing a current which is equal or proportional to the current flowing through the first resistor in the constant current generation circuit to flow through the second resistor, and the constant voltage/constant current generation circuit further comprising a third current mirror circuit for generating a current which is equal or proportion to the current flowing through the first resistor in the constant current generation circuit in the constant voltage generation circuit.

In the constant voltage/constant current generation circuit, a constant voltage and a constant current can be generated in a small area without depending on the variation in power supply voltage, the temperature change, and the variation in processes.

An amplification circuit according to a further aspect of the present invention comprises a plurality of operational amplifiers; and a constant voltage/constant current generation circuit for applying a constant voltage as a reference voltage to an input terminal of at least one of the plurality of operational amplifiers as well as supplying a constant current as a bias current, the constant voltage/constant current generation circuit comprising a constant voltage generation circuit, the constant voltage generation circuit comprising a constant current generation circuit, and a current/voltage conversion circuit for converting a current generated by the constant current generation circuit into a voltage, the constant current generation circuit comprising a first field effect transistor having a threshold voltage Vt, and a first resistor, the first field effect transistor and the first resistor being connected to each other such that the first field effect transistor operates in a saturation region, a voltage applied across both ends of the first resistor is uniquely determined by a gate-source voltage of the first field effect transistor, and a current flowing through the first field effect transistor and a current flowing through the first resistor are equal or proportional to each other, the gate-source voltage of the first field effect transistor being set within a range of not less than (Vt+0.1) volts nor more than (Vt+0.4) volts, the current/voltage conversion circuit comprising a second resistor composed of the same material as that for the first resistor in the constant current generation circuit, and a second current mirror circuit for causing a current which is equal or proportional to the current flowing through the first resistor in the constant current generation circuit to flow through the second resistor, and the constant voltage/constant current generation circuit further comprising a third current mirror circuit for generating a current which is equal or proportion to the current flowing through the first resistor in the constant current generation circuit in the constant voltage generation circuit.

In the amplification circuit according to the present invention, a constant voltage can be applied as a reference voltage to the input terminal of at least one of the plurality of operational amplifiers without depending on the variation in power supply voltage, the temperature change, and the variation in processes, and a constant current can be supplied as a bias current. Consequently, an amplification circuit which does not depend on the variation in power supply voltage, the temperature change, and the variation in processes is realized.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
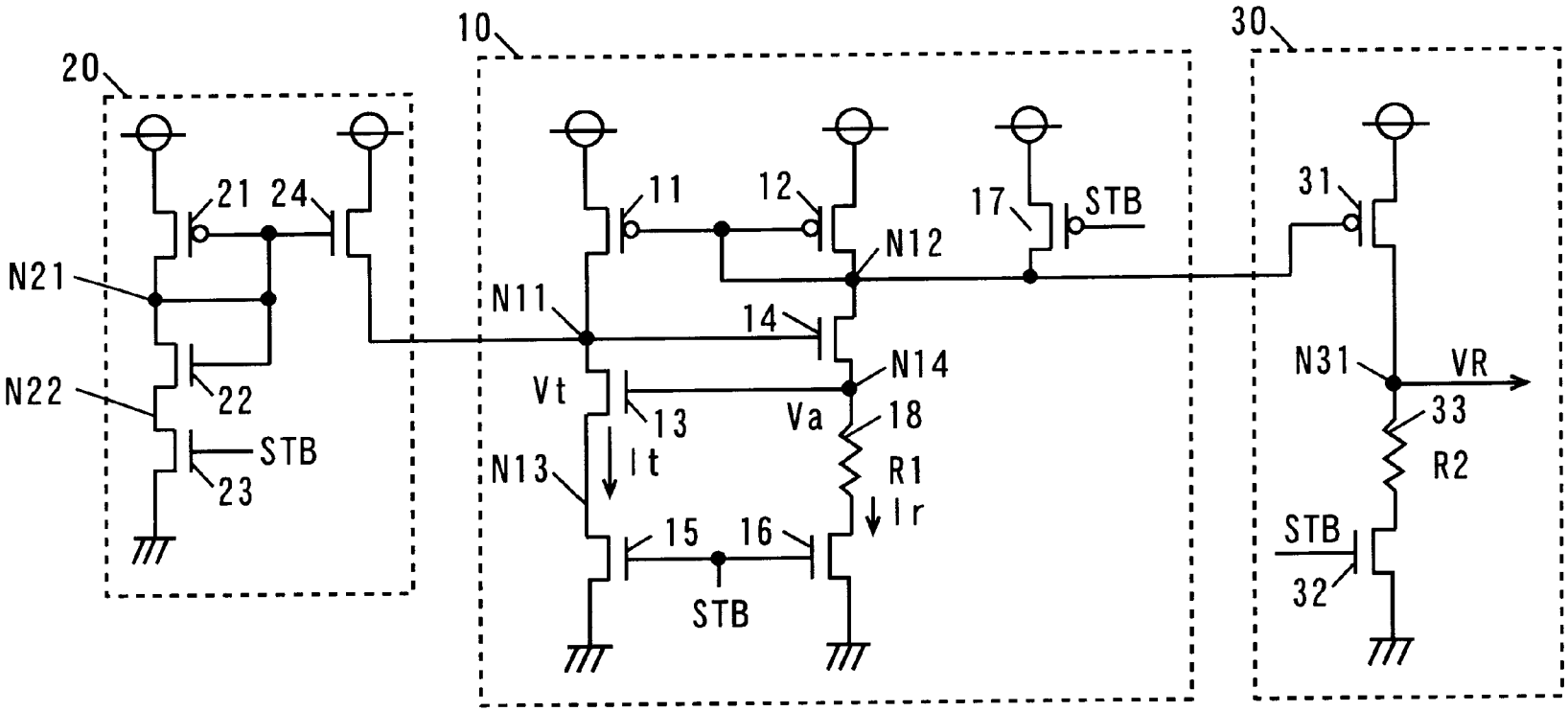
FIG. 1 is a circuit diagram showing the configuration of a constant voltage generation circuit in a first embodiment of the present invention.

FIG. 1 is a circuit diagram showing the configuration of a constant voltage generation circuit in a first embodiment of the present invention.

The constant voltage generation circuit shown in FIG. 1 comprises a constant current generation circuit 10, a power up circuit 20, and a current/voltage conversion circuit 30.

The constant current generation circuit 10 comprises p-channel MOS field effect transistors 11, 12, and 17, n-channel MOS field effect transistors 13, 14, 15, and 16, and a resistor 18.

The transistor 11 has its source connected to a power supply terminal receiving a predetermined power supply voltage, has its drain connected to a node N11, and has its gate connected to a node N12. The transistor 12 has its source connected to the power supply terminal, and has its drain and its gate connected to the node N12. The transistors 11 and 12 constitute a current mirror circuit.

The transistor 13 has its drain connected to the node N11, has its source connected to a node N13, has its gate connected to a node N14. The transistor 14 has its drain connected to the node N12, has its source connected to the node N14, and has its gate connected to the node N11.

The transistor 15 has its drain connected to the node N13, has its source connected to a ground terminal, and has its gate fed with an inverted stand-by signal STB. The transistor 16 has its drain connected to the node N14 through the resistor 18, has its source connected to the ground terminal, and has its gate fed with the inverted stand-by signal STB.

The transistor 17 has its source connected to the power supply terminal, has its drain connected to the node N12, and has its gate fed with the inverted stand-by signal STB.

The power up circuit 20 comprises a p-channel MOS field effect transistor 21 and n-channel MOS field effect transistors 22, 23, and 24. The transistor 21 has its source connected to the power supply terminal, and has its drain and its gate connected to a node N21. The transistor 22 has its drain and its gate connected to the node N21, and has its source connected to a node N22. The transistor 23 has its drain connected to the node N22, has its source connected to the ground terminal, and has its gate fed with the inverted stand-by signal STB. The transistor 24 has its source connected to the power supply terminal, has its drain connected to the node N11, and has its gate connected to the node N21.

The current/voltage conversion circuit 30 comprises a p-channel MOS field effect transistor 31, an n-channel MOS field effect transistor 32, and a resistor 33. The transistor 31 has its source connected to the power supply terminal, has its drain connected to a node N31, and has its gate connected to the node N12. The transistor 12 and the transistor 31 constitute a current mirror circuit.

The transistor 32 has its drain connected to the node N31 through the resistor 33, has its source connected to the ground terminal, and has its gate fed with the inverted stand-by signal.

Used as the resistors 18 and 33 is a resistor composed of two-layer silicon (polycrystalline silicon) having a low temperature coefficient. Consequently, the resistance values of the resistors 18 and 33 are made constant by the temperature change.

When the inverted stand-by signal STB enters a high level, the transistor 23 in the power up circuit 20 is turned on. Consequently, a current flows from the power supply terminal to the ground terminal through the transistors 21, 22 and 23. Consequently, a potential at the node N11 in the constant current generation circuit 10 is prevented from being stabilized at the ground potential. A current flowing through the transistor 24 is as small as a substantially negligible value, and hardly affects the operation of the constant current generation circuit 10.

The transistors 15, 16, and 17 in the constant current generation circuit 10 are turned on. Consequently, a current It flows from the power supply terminal to the ground terminal through the transistors 11, 13, and 15. At this time, the current flowing through the transistor 24 in the power up circuit 20 is small, so that it hardly affects the current It flowing through the constant current generation circuit 10.

At this time, a current Ir which is equal to or a constant multiple of the current It flows from the power supply terminal to the ground terminal through the transistors 12 and 14, the resistor 18, and the transistor 16. Herein, the current Ir which is equal to the current It shall flow from the power supply terminal to the ground terminal through the transistors 12 and 14, the resistor 18, and the transistor 16. In this case, a bias is set such that the transistor 13 operates in a saturation region. Therefore, a voltage Va applied across both ends of the resistor 18 is uniquely determined by a gate-source voltage of the transistor 13. Consequently, a constant voltage is applied across both ends of the resistor 18 irrespective of the power supply voltage, so that the current Ir flowing through the resistor 18 is made constant.

In the current/voltage conversion circuit 30, the transistor 32 is turned on. Consequently, a current which is equal to or a constant multiple of the current Ir flowing through the resistor 18 in the constant current generation circuit 10 flows from the power supply terminal to the ground terminal through the transistor 31, the resistor 33, and the transistor 32. Here, the current which is equal to the current Ir flowing through the resistor 18 shall flow from the power supply terminal to the ground terminal through the transistor 31, the resistor 33, and the transistor 32. At this time, the current flowing through the resistor 33 is made constant, so that a constant voltage VR is outputted from the node N31.

When the resistance value R1 of the resistor 18 in the constant current generation circuit 10 and the resistance value R2 of the resistor 33 in the current/voltage conversion circuit 30 vary by the variation in processes, the resistance value R1 of the resistor 18 and the resistance value R2 of the resistor 33 deviate in the same direction. When both the resistance value R1 of the resistor 18 and the resistance value R2 of the resistor 33 are increased by 10% due to the variation in processes, for example, the current Ir flowing through the resistor 18 is decreased by 10%. Consequently, the voltage VR at the node N31 is expressed by the following equation:

$$VR=R2(1+0.1)\times Ir(1-0.1)\approx R2\times Ir$$

From the foregoing equation, the voltage VR outputted from the current/voltage conversion circuit 30 is made constant without practically depending on the variation in processes. Consequently, the deviation of the resistance value R1 of the resistor 18 is offset by the deviation of the resistance value R2 of the resistor 33.

Figure 5:
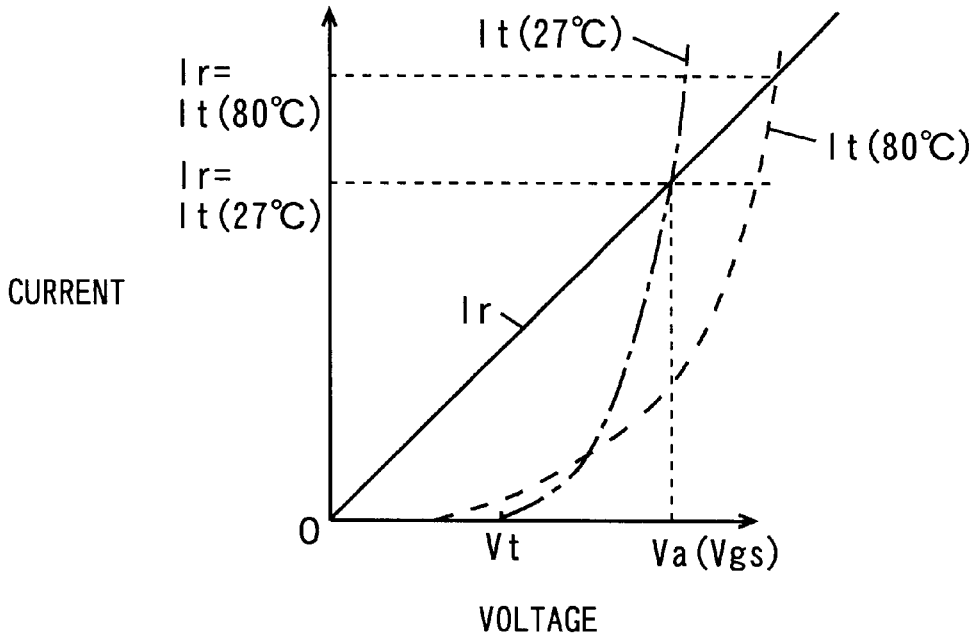
FIG. 5 is a diagram showing current-voltage characteristics of a transistor and current-voltage characteristics of a resistor in a case where no temperature compensation is made in a constant voltage generation circuit.
Figure 6:
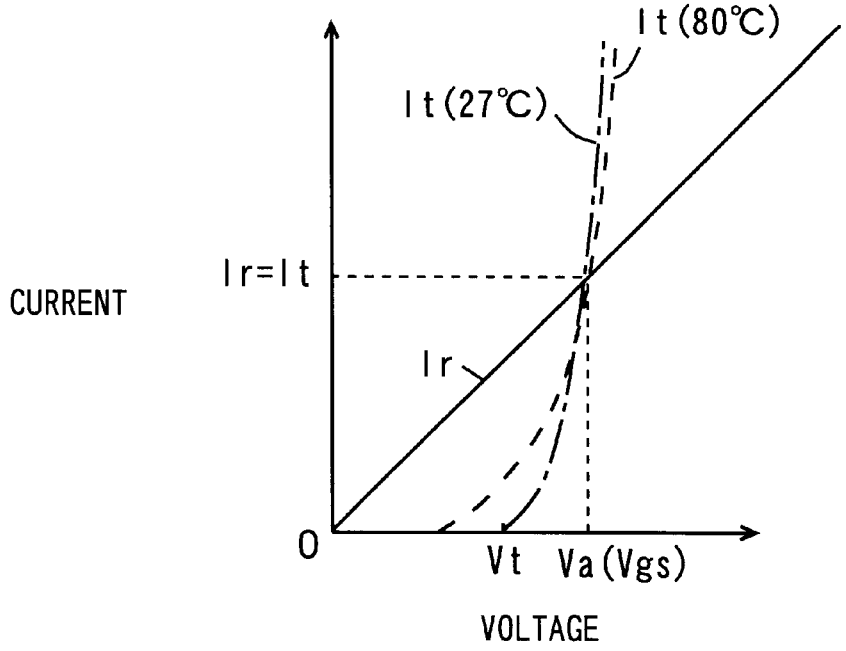
FIG. 6 is a diagram showing current-voltage characteristics of a transistor and current-voltage characteristics of a resistor in a case where temperature compensation is made in a constant voltage generation circuit.

In the constant voltage generation circuit shown in FIG. 1, temperature compensation is made, as described below. FIG. 5 is a diagram showing current-voltage characteristics of the transistor 13 and current-voltage characteristics of the resistor 18 in a case where no temperature compensation is made. FIG. 6 is a diagram showing current-voltage characteristics of the transistor 13 and current-voltage characteristics of the resistor 18 in a case where temperature compensation is made.

In FIGS. 5 and 6, the gate-source voltage of the transistor 13 and the voltage applied across both ends of the resistor 13 are used to enter the horizontal axis, and the current It flowing through the transistor 13 and the current Ir flowing through the resistor 18 are used to enter the vertical axis. In FIGS. 5 and 6, a one-dot and dash line indicates current-voltage characteristics of the transistor 13 at a room temperature of 27° C., and a broken line indicates current-voltage characteristics of the transistor 13 at a temperature of 80° C. Further, a solid line indicates current-voltage characteristics of the resistor 18.

The voltage Va at the node N14 in a case where the current It flowing through the transistor 13 and the current Ir flowing through the resistor 18 are equal to each other does not depend on the power supply voltage. When no temperature compensation is made, as shown in FIG. 5, however, the voltage Va at the node N14 in a case where the current It flowing through the transistor 13 and the current Ir flowing through the resistor 18 are equal to each other differs between room temperatures of 27° C. and 80 C., that is, varies depending on the temperature.

Contrary to this, when temperature compensation described below is made, as shown in FIG. 6, the voltage Va at the node N14 in a case where the current It flowing through the transistor 13 and the current Ir flowing through the resistor 18 are equal to each other is made constant without depending on the temperature.

The temperature compensation is made by adjusting the gate length L and the gate width W of the transistor 13 and changing the current-voltage characteristics of the transistor 13. As next described, if the difference between a threshold voltage Vt of the transistor 13 and the voltage Va at the node N14 (a gate-source voltage Vgs of the transistor 13) is within a range of 0.1 volts to 0.4 volts, characteristics shown in FIG. 6 are obtained.

A source-drain current I in the saturation region of the MOS field effect transistor is expressed by the following equation:

$$I=(Vgs-Vt)^2 \tag{1}$$

In the foregoing equation (1), Vgs denotes the gate-source voltage of the transistor, and Vt denotes the threshold voltage of the transistor. Further, β is expressed by the following equation:

$$\beta=(1/2)\cdot(W/L)\cdot \mathrm{Cox}\cdot\mu \tag{2}$$

In the foregoing equation (2), W denotes the gate width of the transistor, L denotes the gate length of the transistor, Cox denotes the capacitance of a unit oxide film, and $\mu$ denotes the mobility of electrons or holes.

Furthermore, temperature characteristics of the threshold voltage Vt of the transistor is approximated by the following equation:

$$\begin{aligned} Vt(T) &= Vt(Tnom) + \Delta Vt(T) \\ &\approx Vt(Tnom) + (-0.22)\cdot\{(T/Tnom)-1\} \end{aligned} \tag{3}$$

In the foregoing equation (3), Vt(T) denotes a threshold voltage at a certain temperature T, Vt(Tnom) denotes a threshold voltage at a room temperature Tnom, and ΔVt(T) denotes an amount of variation in the threshold voltage by the temperature change from the room temperature Tnom to a temperature T. −0.22 is a constant, which is a typical value of the general MOS field effect transistor. Temperature characteristics of the mobility $\mu$ are approximated by the following equation:

$$\mu(T)\approx\mu(\mathrm{Tnom})\cdot(T/\mathrm{Tnom})^{-1.5} \tag{4}$$

In the foregoing equation (4), $\mu$(T) denotes mobility at the temperature T, and $\mu$ denotes mobility at the room temperature. −1.5 is a constant, which is a typical value of the general MOS field effect transistor.

An amount of variation in the source-drain current I in the saturation region of the MOS field effect transistor by the temperature change is expressed by the following equation from the foregoing equation (1):

$$\begin{aligned} \Delta I(T) &= I(T) - I(Tnom) \\ &= \beta(T)\cdot\{Vgs - Vt(T)\}^2 - \beta(Tnom)\cdot\{Vgs - Vt(Tnom)\}^2 \end{aligned} \tag{5}$$

In the foregoing equation (5), I(T) denotes a source-drain current of the transistor at the temperature T, I(Tnom) denotes a source-drain current of the transistor at the room temperature Tnom, and ΔI(T) denotes an amount of variation in the source-drain current of the transistor by the temperature change from the room temperature Tnom to the temperature T. Further, β(T) is expressed by the following equation:

$$\beta(T)=\mu(\mathrm{Tnom})+\Delta\beta(T) \tag{6}$$

In the foregoing equation (6), β(T) denotes the value of β at the temperature T, (Tnom) denotes the value of β at the room temperature Tnom, and Δβ(T) denotes an amount of variation in the value of β by the temperature change form the room temperature Tnom to the temperature T.

Letting Tnom=300 k (=27° C.) and T=353 k (=80° C.), the mobility $\mu$(T) is expressed by the following equation from the foregoing equation (4):

$$\begin{aligned} \mu(353) &= \mu(300)\cdot(353/300)^{-1.5} \\ &= 0.78\cdot\mu(300) \end{aligned} \tag{7}$$

Accordingly, the following equation is obtained from the foregoing equations (2), (6), and (7):

$$\Delta\beta(353)/\beta(300)=\{\mu(353)-\mu(300)\}/\mu(300)=-0.02 \tag{8}$$

Furthermore, ΔVt(353) is found form the foregoing equation (3):

$$\Delta Vt(353)=(-0.22)\cdot(353/300-1)=-0.039 \tag{9}$$

Accordingly, conditions under which ΔI(T)=0 in the foregoing equation (5) from the foregoing equation (9) are expressed by the following equation:

$$Vgs-Vt(\mathrm{Tnom})=0.2-0.3[V] \tag{10}$$

It is assumed that Vgs−Vt(Tnom)=0.1−0.4[V] in consideration of a margin. That is, the gate-source voltage of the transistor 13 is set within a range from (Vt+0.1)[V] to (Vt+0.4)[V], thereby making it possible to make the source-drain current It flowing through the transistor 13 constant without depending on the temperature change.

In the constant voltage generation circuit shown in FIG. 1, it is possible to generate a constant voltage VR without depending on the variation in power supply voltage, the temperature change, and the variation in processes by a low-cost CMOS circuit.

Figure 2:
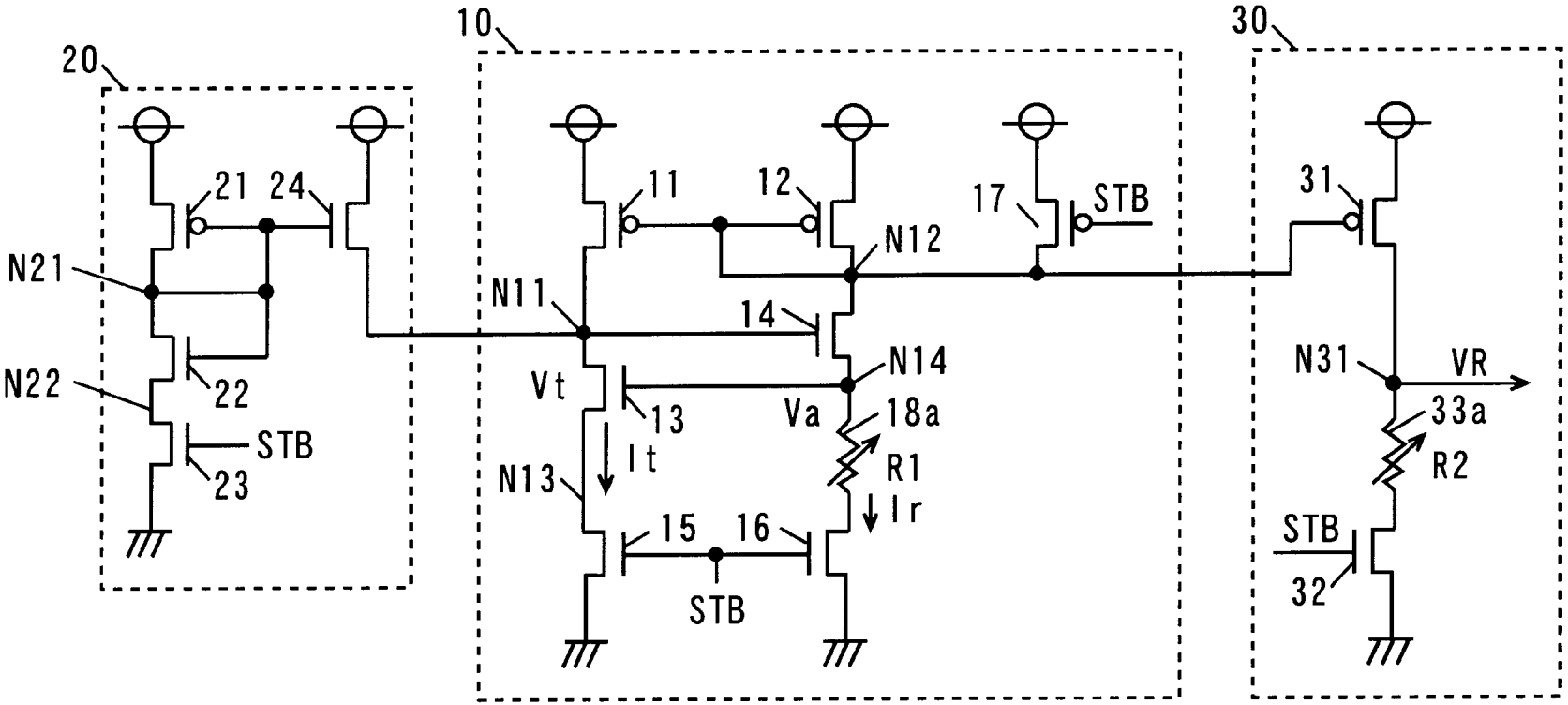
FIG. 2 is a circuit diagram showing the configuration of a constant voltage generation circuit in a second embodiment of the present invention.

FIG. 2 is a circuit diagram showing the configuration of a constant voltage generation circuit in a second embodiment of the present invention.

The constant voltage generation circuit shown in FIG. 2 differs from the constant voltage generation circuit shown in FIG. 1 except that a resistor 18*a* having a programmable function is provided in place of the resistor 18 in the constant current generation circuit 10, and a resistor 33*a* having a programmable function is provided in place of the resistor 33 in the current/voltage conversion circuit 30. The programmable function means that the resistance values of the resistors 18*a* and 33*a* can be adjusted at the time of at least the fabrication.

The programmable function of the resistors 18*a* and 33*a* can be realized by changing a metal mask in the metal mask process at the time of the fabrication. The programmable function of the resistors 18*a* and 33*a* can be also realized by constructing each of the resistors 18*a* and 33*a* using a plurality of resistors and fuses and cutting each of the fuses using lasers or the like to change the connection of the resistors. Further, the programmable function of the resistors 18*a* and 33*a* can be also realized by constructing each of the resistors 18*a* and 33*a* using a plurality of resistors and switches and switching the plurality of resistors using the switches. A method of realizing the programmable function of the resistors 18*a* and 33*a* is not limited to the methods. The programmable function may be realized using other methods.

In the constant voltage generation circuit shown in FIG. 2, when temperature compensation shown in FIG. 6 deviates due to the variation in the characteristics of an n-channel MOS field effect transistor 13, the resistance value R1 and the resistance value R2 of the resistor 18*a* and the resistor 33*a* each having the programmable function are adjusted, thereby making it possible to correct the deviation of the temperature compensation. In the constant voltage generation circuit shown in FIG. 2, therefore, even when the characteristics of the transistor 13 vary, a constant voltage VR can be generated without depending on the variation in power supply voltage, the temperature change, and the variation in processes.

Figure 3:
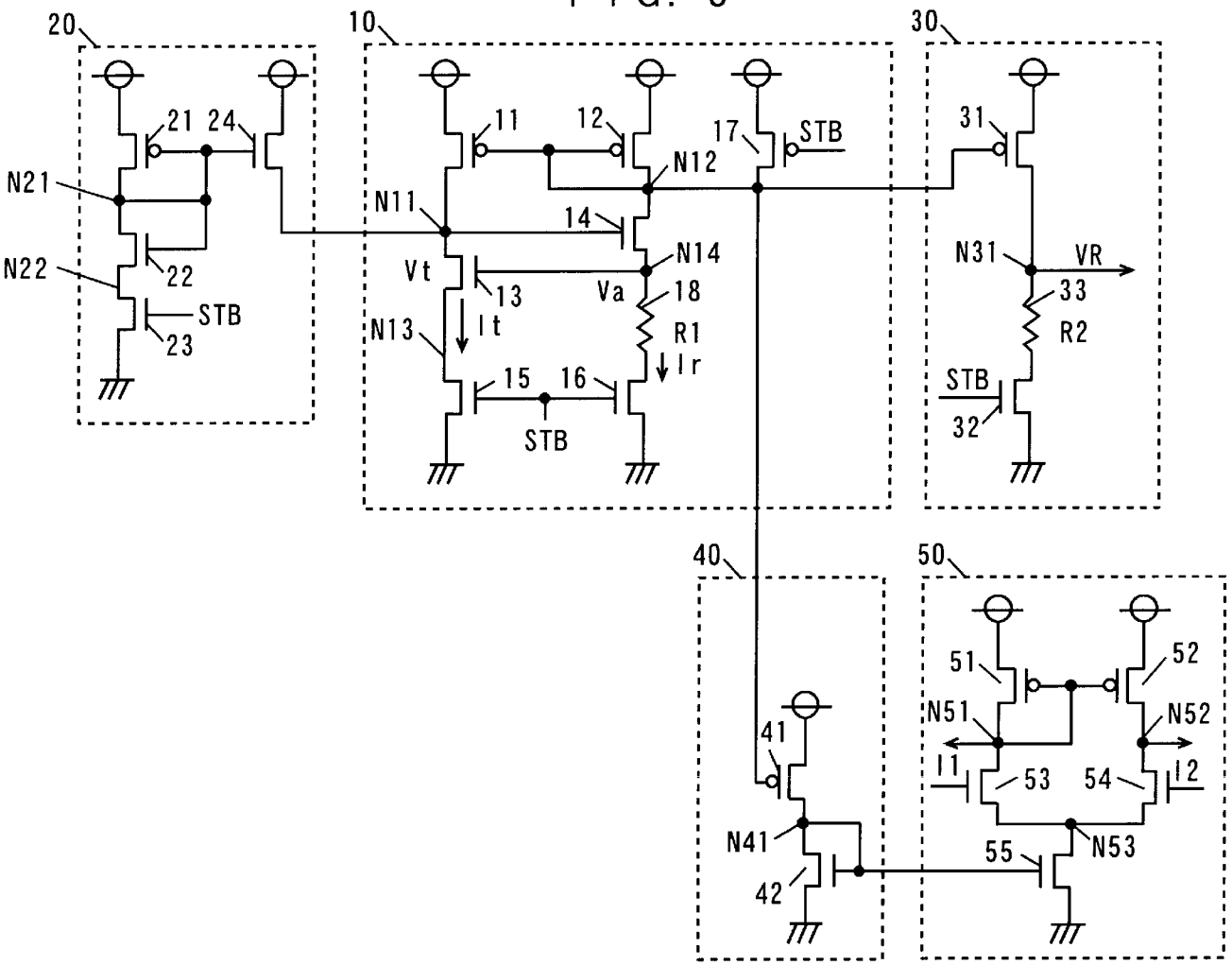
FIG. 3 is a circuit diagram showing the configuration of a constant voltage/constant current generation circuit in a third embodiment of the present invention.

FIG. 3 is a circuit diagram showing the configuration of a constant voltage/constant current generation circuit in a third embodiment of the present invention. The constant voltage/constant current generation circuit shown in FIG. 3 is an example in which the constant current generation circuit 10 shown in FIG. 1 is shared as a constant current source of a constant voltage generation circuit and an operational amplifier.

In FIG. 3, a current copying circuit 40 comprises a p-channel MOS field effect transistor 41 and an n-channel MOS field effect transistor 42. The transistor 41 has its source connected to a power supply terminal, has its drain connected to a node N41, and has its gate connected to a node N12 of a constant current generation circuit 10. The transistor 42 has its source connected to a ground terminal, and has its drain and its gate connected to the node N41. A transistor 12 and the transistor 41 constitute a current mirror circuit.

An operational amplifier 50 comprises p-channel MOS field effect transistors 51 and 52 and n-channel MOS field effect transistors 53, 54, and 55. The transistor 51 has its source connected to the power supply terminal, and has its drain and its gate connected to a node N51. The transistor 52 has its source connected to the power supply terminal, has its drain connected to a node N52, and has its gate connected to the node N51. The transistor 53 has its drain connected to the node N51, has its source connected to a node N53, and has its gate fed with an input signal I1. The transistor 54 has its drain connected to the node N52, has its source connected to the node N53, and has its gate fed with an input signal I2. The transistor 55 has its drain connected to the node N53, has its source connected to the ground terminal, and has its gate connected to the node N41.

When an inverted stand-by signal STB enters a high level, a current which is equal to or a constant multiple of a current Ir flowing through a resistor 18 in the constant current generation circuit 10 flows from the power supply terminal of the current copying circuit 40 to the ground terminal through the transistors 41 and 42. Here, a current which is equal to the current Ir flowing through the resistor 18 in the constant current generation circuit 10 shall flow through the transistors 41 and 42 in the current copying circuit 40.

A current which is equal to or a constant multiple of the current flowing through the transistors 41 and 42 in the current copying circuit 40 flows through the transistor 55 in the operational amplifier 50. Here, a current which is equal to the current flowing through the transistors 41 and 42 shall flow through the transistor 55. In this case, the current flowing through the transistor 55 is made constant, so that the transistor 55 functions as a constant current source for supplying a predetermined bias current.

The input signals I1 and I2 fed to the gates of the transistors 53 and 54 in the operational amplifier 50 are differentially amplified, so that the amplified output voltages are respectively outputted from the nodes N51 and N52.

On the other hand, a constant voltage VR is outputted from a current/voltage conversion circuit 30. The voltage VR outputted from the current/voltage conversion circuit 30 can be used as a reference voltage.

In the constant voltage/constant current generation circuit shown in FIG. 3, a reference voltage generation circuit capable of generating a constant reference voltage without depending on the variation in power supply voltage, the temperature change, and the variation in processes, and a bias current generation circuit for supplying a constant bias current to the operational amplifier 50 can be realized in a small area.

Figure 4:
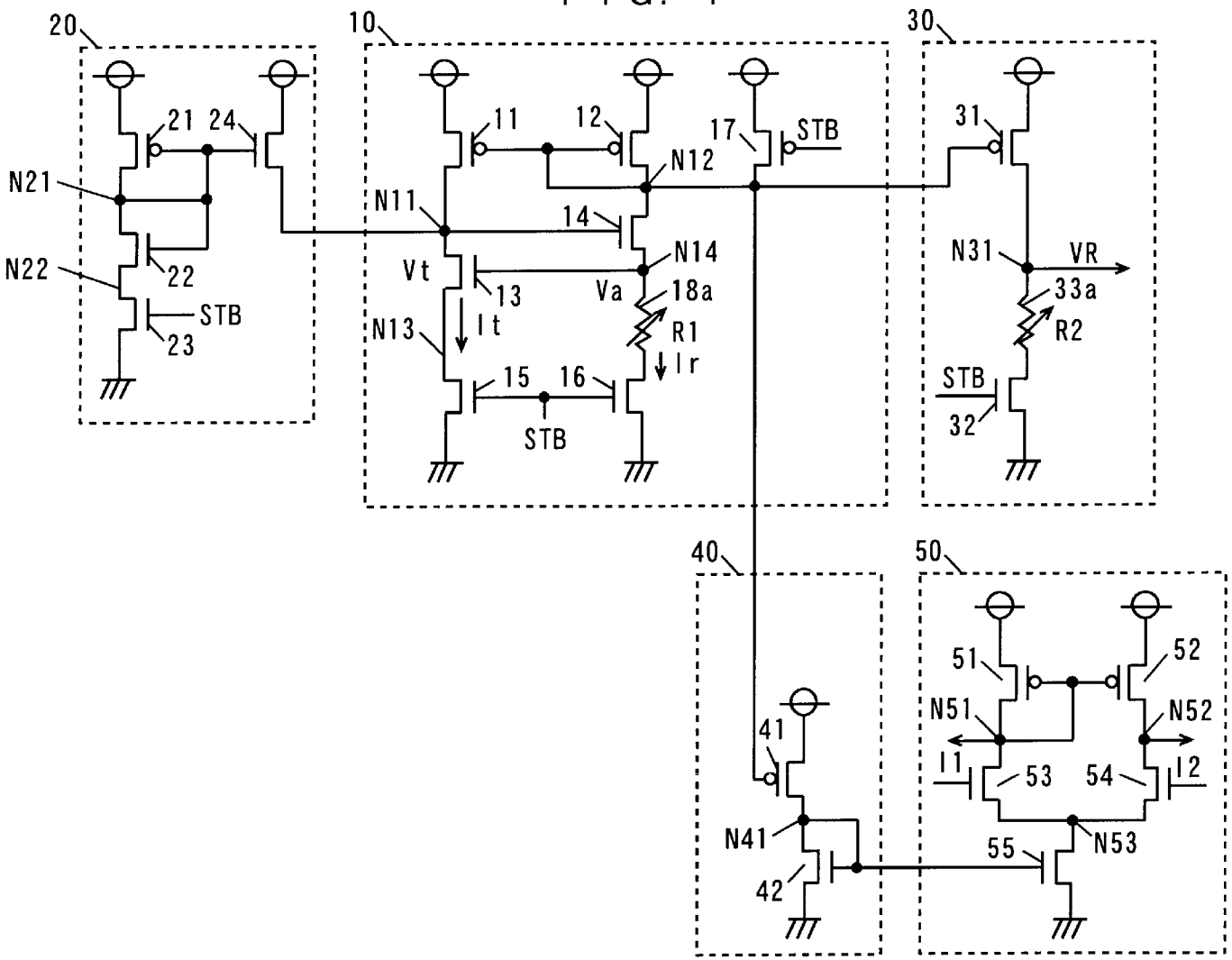
FIG. 4 is a circuit diagram showing the configuration of a constant voltage/constant current generation circuit in a fourth embodiment of the present invention.

FIG. 4 is a circuit diagram showing the configuration of a constant voltage/constant current generation circuit in a fourth embodiment of the present invention. The constant voltage/constant current generation circuit shown in FIG. 4 is an example in which the constant current generation circuit 10 shown in FIG. 2 is shared as a constant current source of a constant voltage generation circuit and an operational amplifier.

The constant voltage/constant current generation circuit shown in FIG. 4 is the same as the constant voltage/constant current generation circuit shown in FIG. 3 except that a resistor 18*a* having a programmable function is used in place of the resistor 18 in the constant current generation circuit 10, and a resistor 33*a* having a programmable function is used in place of the resistor 33 in the current/voltage conversion circuit 30.

In the constant voltage/constant current generation circuit shown in FIG. 4, when temperature compensation shown in FIG. 6 deviates due to the variation in the characteristics of an n-channel MOS field effect transistor 13, the resistance value R1 and the resistance value R2 of the resistor 18*a* and the resistor 33*a* each having the programmable function are adjusted, thereby making it possible to correct the deviation of the temperature compensation. In the constant voltage/constant current generation circuit shown in FIG. 4, even when the characteristics of the transistor 13 vary, therefore, a reference voltage generation circuit capable of generating a constant reference voltage without depending on the variation in power supply voltage, the temperature change, and the variation in processes, and a bias current generation circuit for supplying a constant bias current to an operational amplifier 50 can be realized in a small area.

The configurations of the operational amplifiers 50 shown in FIGS. 3 and 4 are examples. Operational amplifiers having various configurations can be used.

Figure 7:
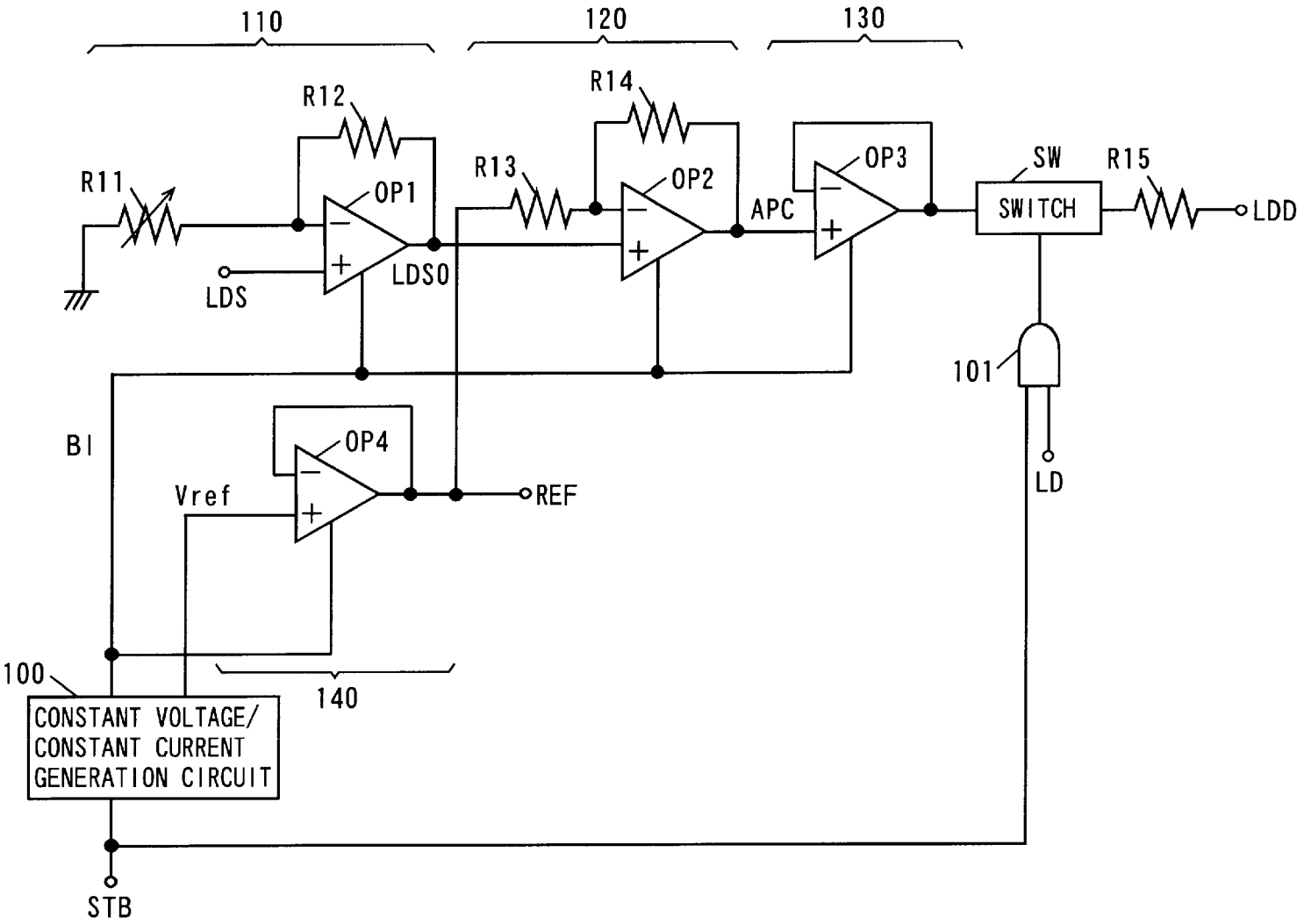
FIG. 7 is a circuit diagram showing the configuration of an ALPC circuit using the constant voltage/constant current generation circuit shown in FIG. 3 or 4.
Figure 8:
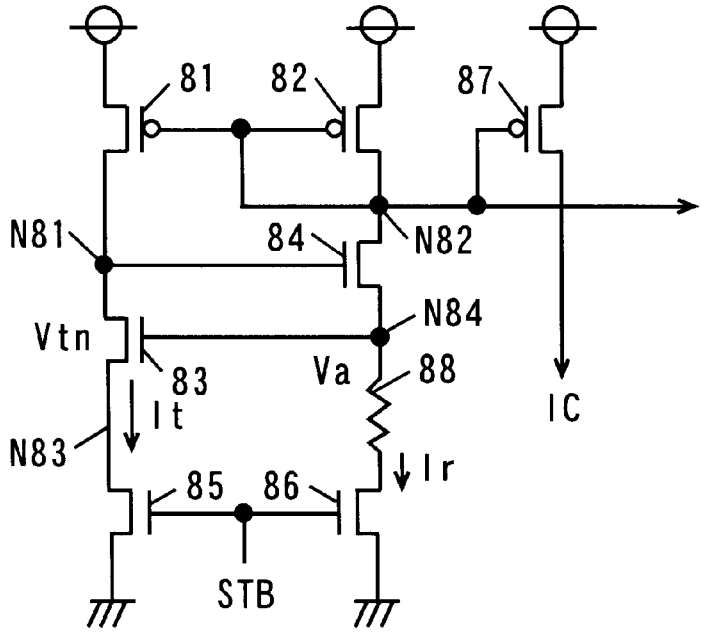
FIG. 8 PRIOR ART
FIG. 8 is a circuit diagram showing an example of a conventional constant current generation circuit.

FIG. 7 is a circuit diagram showing the configuration of an ALPC (Auto Laser Power Control) circuit using the constant voltage/constant current generation circuit shown in FIGS. 3 or 4. The ALPC circuit shown in FIG. 7 comprises operational amplification circuits 110 and 120, voltage followers 130 and 140, a switch SW, a resistor R15, a constant voltage/constant current generation circuit 100, and an AND circuit 101. The constant voltage/constant current generation circuit 100 has the configuration shown in FIG. 3 or 4.

The operational amplification circuit 110 comprises an operational amplifier OP1, a variable resistor R11, and a resistor R12. The operational amplifier 120 comprises an operational amplifier OP2 and resistors R13 and R14. The voltage follower 130 comprises an operational amplifier OP3. The voltage follower 140 comprises an operational amplifier OP4.

An inverted stand-by signal STB is fed to respective one input terminals of the constant voltage/constant current generation circuit 110 and the AND circuit 101. A laser lighting signal LD is fed to the other input terminal of the AND circuit 101. When the inverted stand-by signal STB enters a high level and the laser lighting signal LD enters a high level, an output signal of the AND circuit 101 enters a high level. Consequently, the switch SW is turned on.

The constant voltage/constant current generation circuit 100 supplies a constant current as a bias current B1 to the operational amplifiers OP1, OP2, OP3, and OP4. Further, the constant voltage/constant current generation circuit 100 applies a constant voltage as a reference voltage Vref to a non-inverted input terminal of the operational amplifier OP4 in the voltage follower 140.

The voltage follower 140 performs impedance conversion, to output a predetermined reference voltage REF.

An output voltage LDS of a monitoring photodiode for monitoring laser light emitted from a laser diode is fed to a non-inverted input terminal of the operational amplifier OP1 in the operational amplification circuit 110. The operational amplification circuit 110 amplifies the output voltage LDS of the photodiode with gain determined by the resistance values of the variable resistor R11 and the resistor R12, to output an amplified monitoring voltage LDS0.

The operational amplification circuit 120 amplifies the difference between the monitoring voltage LDS0 and the reference voltage REF, to output an amplified differential voltage APC. The voltage follower 130 performs impedance conversion, to output the differential voltage APC as a laser diode driving voltage LDD through the switch SW and the resistor R15. The laser diode driving voltage LDD is fed to the laser diode.

The ALPC circuit carries out control such that the laser diode driving voltage LDD is lowered and a driving current for driving the laser diode is increased when the monitoring voltage LDS is lowered, and the laser diode driving voltage LDD is increased and the driving current for driving the laser diode is decreased when the monitoring voltage LDS is raised. Consequently, light output power of the laser light emitted from the laser diode is made constant.

In the APC circuit shown in FIG. 7, the constant voltage/constant current generation circuit shown in FIGS. 3 or 4 is used. Therefore, it is possible to apply to the operational amplifier OP4 a predetermined reference voltage Vref which does not depend on the variation in power supply voltage, the temperature change, and the variation in processes as well as to supply to the operational amplifiers OP1, OP2, OP3, and OP4 a constant bias current which does not depend on the variation in power supply voltage, the temperature change, and the variation in processes.

Consequently, the light output power of the laser light emitted from the laser diode can be made constant without depending on the variation in power supply voltage, the temperature change, and the variation in processes.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A constant current generation circuit comprising:

a first field effect transistor having a threshold voltage Vt; and a first resistor, said first field effect transistor and said first resistor being connected to each other such that said first field effect transistor operates in a saturation region, a voltage applied across both ends of said first resistor is uniquely determined by a voltage between the gate and the source of said first field effect transistor, and a current flowing through said first field effect transistor and a current flowing through said first resistor are equal or proportional to each other, and the voltage between the gate and the source of said first field effect transistor being set within a range of not less than (Vt+0.1) volts nor more than (Vt+0.4) volts.

2. The constant current generation circuit according to claim 1, further comprising a first current mirror circuit for respectively causing currents which are equal or proportional to each other to flow through said first field effect transistor and said first resistor.

3. The constant current generation circuit according to claim 1, further comprising a second field effect transistor, said first current mirror circuit comprising third and fourth field effect transistors, said first field effect transistor having its gate electrically connected to one end of said resistor, having its source electrically connected to the other end of said resistor, and having its drain electrically connected to the drain of said third field effect transistor, said second field effect transistor having its gate electrically connected to the drain of said first field effect transistor, having its source electrically connected to said one end of said resistor, and having its drain electrically connected to the drain of said fourth field effect transistor, said third field effect transistor having its source electrically connected to a predetermined potential, and having its gate electrically connected to the gate and the drain of said fourth field effect transistor, and said fourth field effect transistor having its source electrically connected to said predetermined potential.

4. The constant current generation circuit according to claim 3, wherein said first, second, third and fourth field effect transistors are metal oxide semiconductor field effect transistors.

5. The constant current generation circuit according to claim 3, further comprising potential holding means for holding the drain of said first field effect transistor at a predetermined potential.

6. The constant current generation circuit according to claim 1, wherein the resistance value of said first resistor is adjustable at the time of at least the fabrication.

7. The constant current generation circuit according to claim 1, wherein said first resistor is composed of polycrystalline silicon.

8. The constant current generation circuit according to claim 1, wherein the gate length and the gate width of said first field effect transistor are set such that a voltage applied across both ends of said first resistor at a first temperature and a voltage applied across both ends of said first resistor at a second temperature different from the first temperature are equal to each other.

9. The constant current generation circuit according to claim 1, wherein said first resistor is constructed using a plurality of resistors and a switch, and has a programmable function by switching said plurality of resistors using said switch.

10. A constant voltage generation circuit comprising a constant current generation circuit; and a current/voltage conversion circuit for converting a current flowing through said constant current generation circuit into a voltage, said constant current generation circuit comprising a first field effect transistor having a threshold voltage Vt, and a first resistor, said first field effect transistor and said first resistor being connected to each other such that said first field effect transistor operates in a saturation region, a voltage applied across both ends of said first resistor is uniquely determined by a voltage between the gate and the source of said field effect transistor, and a current flowing through said first field effect transistor and a current flowing through said first resistor are equal or proportional to each other, the voltage between the gate and the source of said first field effect transistor being set within a range of not less than (Vt+0.1) volts nor more than (Vt+0.4) volts, and said current/voltage conversion circuit comprising a second resistor composed of the same material as that for said first resistor in said constant current generation circuit, and a second current mirror circuit for causing a current which is equal or proportional to a current flowing through said first resistor in the constant current generation circuit.

11. The constant voltage generation circuit according to claim 10, wherein the resistance value of said second resistor is adjustable at the time of at least the fabrication.

12. The constant voltage generation circuit according to claim 10, wherein said constant current generation circuit further comprises a first current mirror circuit for respectively causing currents which are equal or proportional to each other to flow through said first field effect transistor and said first resistor.

13. The constant current generation circuit according to claim 10, further comprising a second field effect transistor, said first current mirror circuit comprising third and fourth field effect transistors, said first field effect transistor having its gate electrically connected to one end of said resistor, having its source electrically connected to the other end of said resistor, and having its drain electrically connected to said third field effect transistor, said second field effect transistor having its gate electrically connected to the drain of said first field effect transistor, having its source electrically connected to said one end of said resistor, and having its drain electrically connected to the drain of said fourth field effect transistor, said third field effect transistor having its source electrically connected to a predetermined potential, and having its gate electrically connected to the gate and the drain of said fourth field effect transistor, and said fourth field effect transistor having its source electrically connected to the predetermined potential.

14. The constant current generation circuit according to claim 13, wherein said first, second, third and fourth field effect transistors are metal oxide semiconductor field effect transistors.

15. The constant current generation circuit according to claim 10, wherein said constant current generation circuit further comprises potential holding means for holding the drain of said first field effect transistor at a predetermined potential.

16. The constant current generation circuit according to claim 10, wherein the resistance value of said first resistor is adjustable at the time of at least the fabrication.

17. The constant current generation circuit according to claim 10, wherein said first resistor is composed of polycrystalline silicon.

18. The constant current generation circuit according to claim 10, wherein the gate length and the gate width of said first field effect transistor are set such that a voltage applied across both ends of said first resistor at a first temperature and a voltage applied across both ends of said first resistor at second temperature different from the first temperature are equal to each other.

19. The constant current generation circuit according to claim 10, wherein said second resistor is constructed using a plurality of resistors and a switch, and has a programmable function by switching said plurality of resistors using said switch.

20. The constant current generation circuit according to claim 10, wherein said first resistor is constructed using a plurality of resistors and a switch, and has a programmable function by switching said plurality of resistors using said switch.

21. A constant voltage/constant current generation circuit comprising a constant voltage generation circuit, said constant voltage generation circuit comprising a constant current generation circuit, and a current/voltage conversion circuit for converting a current flowing through said constant current generation circuit into a voltage, said constant current generation circuit comprising a first field effect transistor having a threshold voltage Vt, and a first resistor, said first field effect transistor and said first resistor being connected to each other such that said first field effect transistor operates in a saturation region, a voltage applied across both ends of said first resistor is uniquely determined by a voltage between the gate and the source of said first field effect transistor, and a current flowing through said first field effect transistor and a current flowing through said first resistor are equal or proportional to each other, the voltage between the gate and the source of said first field effect transistor being set within a range of not less than (Vt+0.1) volts nor more than (Vt+0.4) volts, said current/voltage conversion circuit comprising a second resistor composed of the same material as that for said first resistor in said constant current generation circuit, and a second current mirror circuit for causing a current which is equal or proportional to the current flowing through said first resistor in said constant current generation circuit to flow through said second resistor, and said constant voltage/constant current generation circuit further comprising a third current mirror circuit for generating a current which is equal or proportion to the current flowing through said first resistor in said constant current generation circuit in said constant voltage generation circuit.

22. An amplification circuit comprising:

a plurality of operational amplifiers; and a constant voltage/constant current generation circuit for applying a constant voltage as a reference voltage to an input terminal of at least one of the plurality of operational amplifiers as well as supplying a constant current as a bias current, said constant voltage/constant current generation circuit comprising a constant voltage generation circuit, said constant voltage generation circuit comprising a constant current generation circuit, and a current/voltage conversion circuit for converting a current flowing through said constant current generation circuit into a voltage, said constant current generation circuit comprising a first field effect transistor having a threshold voltage Vt, and a first resistor, said first field effect transistor and said first resistor being connected to each other such that said first field effect transistor operates in a saturation region, a voltage applied across both ends of said first resistor is uniquely determined by a voltage between the gate and the source of said first field effect transistor, and a current flowing through said first field effect transistor and a current flowing through said first resistor are equal or proportional to each other, the voltage between the gate and the source of said first field effect transistor being set within a range of not less than (Vt+0.1) volts nor more than (Vt+0.4) volts, said current/voltage conversion circuit comprising a second resistor composed of the same material as that for said first resistor in said constant current generation circuit, and a second current mirror circuit for causing a current which is equal or proportional to the current flowing through said first resistor in the constant current generation circuit to flow through said second resistor, and said constant voltage/constant current generation circuit further comprising a third current mirror circuit for generating a current which is equal or proportion to the current flowing through said first resistor in said constant current generation circuit in said constant voltage generation circuit.

* * * * *